US009062910B2

(12) United States Patent
Kim et al.

(10) Patent No.: US 9,062,910 B2
(45) Date of Patent: Jun. 23, 2015

(54) REFRIGERATOR

(71) Applicant: LG ELECTRONICS INC., Seoul (KR)

(72) Inventors: Taegyeong Kim, Seoul (KR); Ayoung Choo, Seoul (KR); Jaeyoul Lee, Seoul (KR); Nami Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/175,296

(22) Filed: Feb. 7, 2014

(65) Prior Publication Data

US 2014/0252938 A1 Sep. 11, 2014

(30) Foreign Application Priority Data

Mar. 8, 2013 (KR) ..... 10-2013-0024907

(51) Int. Cl.
*F25D 25/02* (2006.01)
*F25D 23/00* (2006.01)

(52) U.S. Cl.
CPC ..... *F25D 25/025* (2013.01); *F25D 23/00* (2013.01); *F25D 25/024* (2013.01)

(58) Field of Classification Search
CPC ..... F25D 25/02; F25D 25/021; F25D 25/024; F25D 25/025
USPC ..... 312/401, 404, 408, 410, 402, 351; 62/382; 108/108, 143
See application file for complete search history.

(56) References Cited

U.S. PATENT DOCUMENTS

| | | | | | |
|---|---|---|---|---|---|
| 2,825,617 | A * | 3/1958 | Morgan | 312/351 |
| 4,665,713 | A * | 5/1987 | Delatte | 62/382 |
| 4,735,470 | A * | 4/1988 | Falk | 312/246 |
| 4,936,641 | A * | 6/1990 | Bussan et al. | 312/408 |
| 5,044,704 | A * | 9/1991 | Bussan et al. | 312/402 |
| 6,565,169 | B1 * | 5/2003 | Moreno-Olguin et al. | 312/404 |
| 8,152,255 | B2 * | 4/2012 | Nam et al. | 312/404 |
| 2009/0051257 | A1 * | 2/2009 | Picken et al. | 312/408 |
| 2009/0056365 | A1 * | 3/2009 | Benz et al. | 62/441 |
| 2009/0173100 | A1 * | 7/2009 | Kang et al. | 62/407 |
| 2011/0001415 | A1 * | 1/2011 | Park et al. | 312/408 |
| 2012/0146477 | A1 * | 6/2012 | Bischofberger et al. | 312/404 |

* cited by examiner

*Primary Examiner* — James O Hansen
(74) *Attorney, Agent, or Firm* — KED & Associates LLP

(57) ABSTRACT

A refrigerator is provided. The refrigerator may include a main body having at least one storage chamber, a drawer mount installed in the at least one storage chamber that guides at least one drawer provided therein so as to be inserted into and pulled out of the at least one storage chamber, a cover configured to cover an upper opening of the at least one drawer and including guide grooves formed at left and right edges of the cover and guide rails mounted in the guide grooves and formed of metal, a shelf supported by the cover so as to be slidable on the cover by the guide rails, and a pair of supports provided at both sides of a lower surface of the shelf.

31 Claims, 10 Drawing Sheets

REFRIGERATOR

CROSS-REFERENCE TO RELATED APPLICATION(S)

Pursuant to 35 U.S.C. §119(a), this application claims priority to Korean Patent Application No. 10-2013-0024907, filed in Korea on Mar. 8, 2013, which is hereby incorporated by reference as if fully set forth herein.

BACKGROUND

1. Field

A refrigerator is disclosed herein.

2. Background

Refrigerators are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
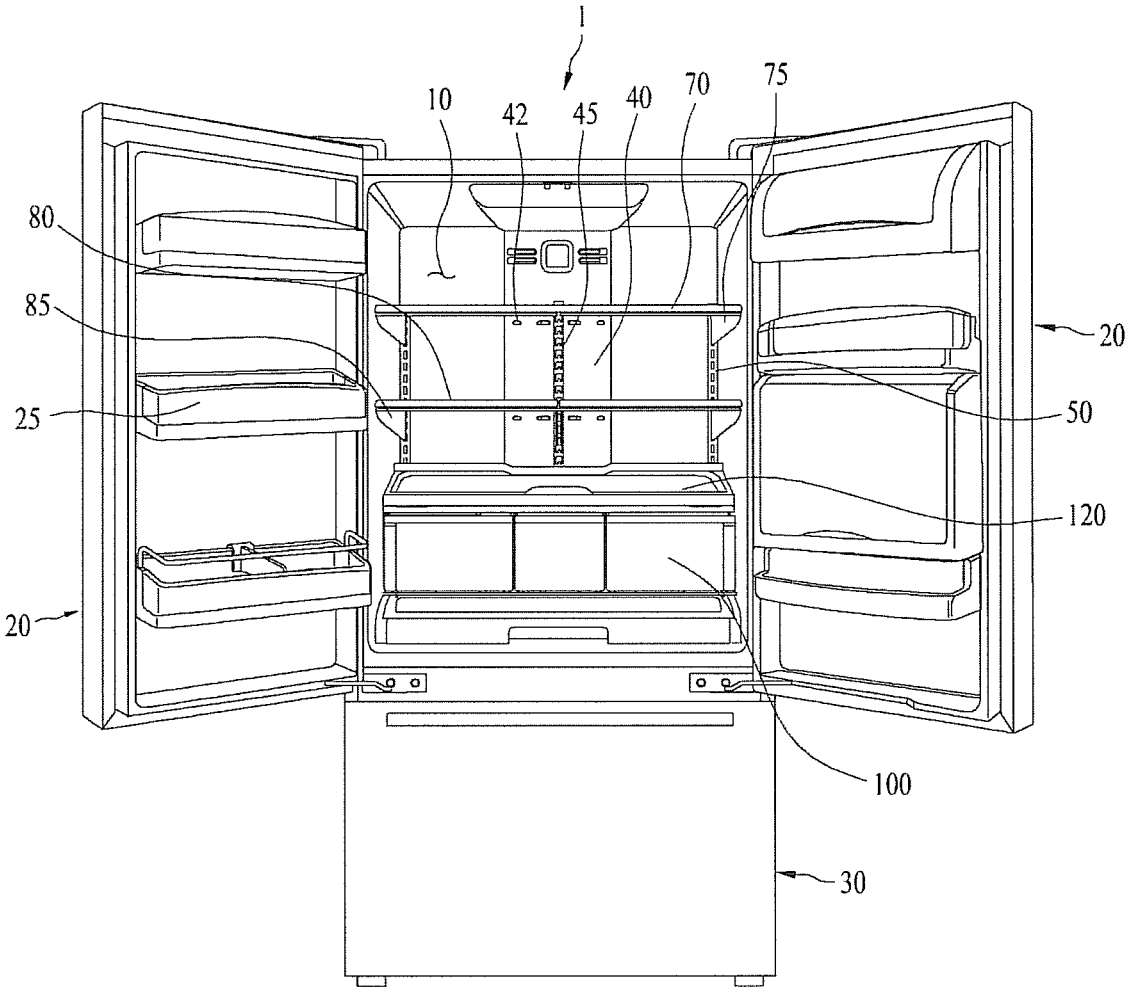
FIG. 1 is a front perspective view of a refrigerator in accordance with an embodiment.

Reference will now be made in detail to embodiments, examples of which are illustrated in the accompanying drawings. Where possible, like reference numerals have been used to indicate like elements and repetitive disclosure has been omitted.

In general, a refrigerator is an apparatus that stores food in a frozen state or in a refrigerated state by lowering a temperature of a storage chamber by discharging cool air, generated by a refrigerating cycle including a compressor, a condenser, an expansion valve, and an evaporator. Such a refrigerator may generally include a freezing chamber that stores food or drinks in a frozen state and a refrigerating chamber that stores food or drinks at a low temperature. Further, a Kimchi refrigerator to store food, such as Kimchi, or vegetables in a fresh state is a kind of refrigerator.

At least one of a plurality of doors installed on the refrigerator may be connected to one side of a main body of the refrigerator by a hinge and may be rotated so as to open and close a front surface of the main body. In addition to the door rotated by the hinge, a drawer type door mounted on the front surface of a drawer and inserted or pulled out in forward and backward directions together with the drawer may be used.

In order to accommodate various sizes of food and to increase space utilization, the freezing chamber and the refrigerating chamber of the refrigerator may be provided with a plurality of shelves that divides the freezing chamber and the refrigerating chamber into upper and lower spaces. Further, the refrigerating chamber may be provided with a vegetable room to store vegetables or fruits separately from other spaces of the refrigerator chamber.

The vegetable room may be formed as a drawer, and an upper opening of the drawer may be closed by a shelf. Further, a closed drawer may be provided in the freezing chamber, and a shelf may be provided on the closed drawer so that a storage space within the drawer may be closed by the shelf.

As the shelf may be fixed to a sidewall of the refrigerating chamber or the freezing chamber so as to close the drawer, it is difficult to retrieve a stored article from a rear portion of the shelf. More particularly, as refrigerators recently tend to increase in size, if many stored articles are accommodated on the shelf, it is more difficult to retrieve a stored article from the rear portion of the shelf.

Figure 2:
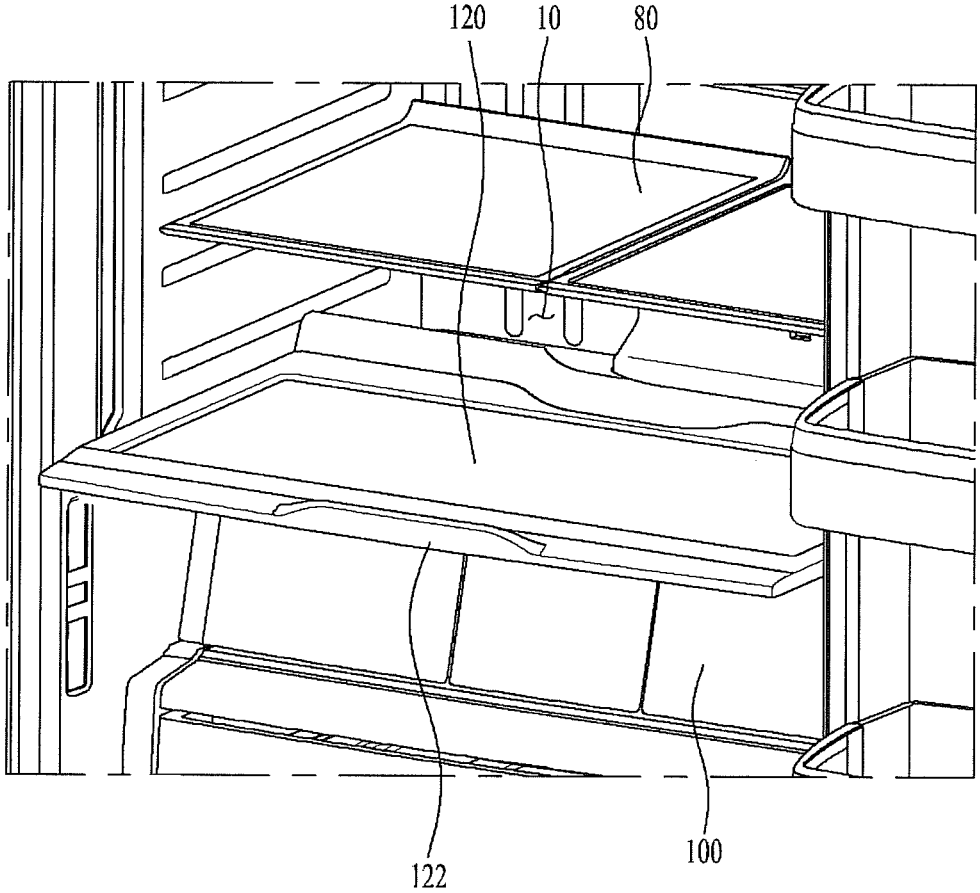
FIG. 2 is a partial perspective view of an inside of a refrigerating chamber of the refrigerator of FIG. 1.

FIG. 1 is a perspective view of a refrigerator in accordance with an embodiment, and FIG. 2 is a partial perspective view of an inside of a refrigerating chamber of the refrigerator of FIG. 1.

Although the refrigerator in accordance with this embodiment is a bottom freezer type refrigerator, in which a refrigerating chamber is provided in an upper portion and a freezing chamber is provided in a lower portion, embodiments are not limited thereto. That is, embodiments may be applied to a side by side type refrigerator, in which a freezing chamber and a refrigerating chamber are disposed side by side, or a top mounting type refrigerator, in which a freezing chamber is disposed above a refrigerating chamber.

As exemplarily shown in FIG. 1, a refrigerating chamber 10 and a freezing chamber may be provided as storage chambers in a main body 1 of the refrigerator, and a pair of refrigerating chamber doors 20 and a freezing chamber door 30 may be provided at opened front surfaces of the refrigerating chamber 10 and the freezing chamber, so as to open and close the refrigerating chamber 10 and the freezing chamber. The pair of refrigerating chamber doors 20 may be rotatably mounted at both sides of the opened front surface of the refrigerating chamber 10, and the freezing chamber door 30 may be provided as a drawer type door.

A plurality of shelves 25 may be provided on inner surfaces of the refrigerating chamber doors 20 so as to accommodate articles. Drawer(s) 100 that form spaces separated from other spaces within the refrigerating chamber 10 and that store food may be provided in a lower portion of the refrigerating chamber 10.

Each of the drawer(s) 100 may be generally formed as a rectangular parallelepipedal box provided with an opened upper surface. The opened upper surface of the drawer(s) 100 may be covered by a shelf 120 provided thereon, and thus, closed spaces may be formed within the drawer(s) 100. Vegetables or fruits may be stored in the drawer(s) 100. Although a single drawer 100 may be provided, a plurality of drawers 100 is exemplarily shown in FIG. 1. Further, as the drawer(s) 100, a drawer 100 having a width corresponding to a width of the refrigerating chamber 10 may be installed or provided, two drawers 100 having a width corresponding to half the width of the refrigerating chamber 100 may be installed or provided side by side, or three or more drawers 100 may be installed or provided. The opened upper surfaces of the respective drawer(s) 100 may be covered with other drawers or covered with shelves so that insides of the respective drawers 100 may be divided from other spaces in the refrigerating chamber 10.

A plurality of shelves 70 and 80 may be mounted in an upper portion of the refrigerating chamber 10. The shelves 70 and 80 together with the shelf 120, which may cover the drawers 100, may divide an upper space of the refrigerating chamber 10, and support stored articles, such as food, accommodated thereon. The shelves 70 and 80 may be supported by a pair of cantilevers 75 and a pair of cantilevers 85 combined with both sides of the respective shelves 70 and 80 and mounted on a pair of cantilever mounting rails 50, as exemplarily shown in FIG. 1.

A first shelf 70 disposed in an upper portion of the refrigerating chamber 10 may have a width similar that a width of the refrigerating chamber 10, and the second shelves 80 disposed below the first shelf 70 may have a width similar to half the width of the refrigerating chamber 10. Therefore, while the first shelf 70 may be supported by the pair of cantilever mounting rails 50, a first side of each of the second shelves 80 may be supported by one of the cantilever mounting rails 50 and a second side of each of the second shelves 80 may be supported on a separate cantilever mounting rail 45 installed at a center of a rear wall of the refrigerating chamber 10.

Further, heights of the first shelf 70 and the two second shelves 80 may be interchanged, or positions of the first shelf 70 and the two second shelves 80 may be interchanged. Further, the two second shelves 80 may be mounted at different heights.

Although the central cantilever mounting rail 45 may be separately installed on the rear wall, the central cantilever mounting rail 45 may be mounted in a groove formed at a center of a multi-duct 40, on which a plurality of cool air discharge holes 42 may be formed. By mounting the central cantilever mounting rail 45 together with the multi-duct 40, cool air may be uniformly supplied to spaces divided by the respective shelves 70 and 80 and the cantilever mounting rails 45 and 50 may be effectively installed.

As exemplarily shown in FIG. 2, the refrigerator in accordance with this embodiment may include the shelf 120 mounted on the drawer(s) 100 mounted in the refrigerating chamber 100, as one example of a storage chamber, so as to be pulled out. The shelf 120 may be mounted so as to be pulled out independently regardless of a withdrawal state of the drawer(s) 100. The shelf 120 may close an entirety of opened upper surfaces of the drawer(s) 100 and then, open some of rear portions of the opened upper surfaces of the drawer(s) 100 when the shelf 120 is pulled out.

As indicated above, as the drawer(s) 100, one drawer 100 having a width similar to a width of the refrigerating chamber 100 may be installed or provided, or two or more drawers 100 disposed side by side may be mounted so as to be pulled out.

FIGS. 1 and 2 illustrate three drawers 100 mounted or installed under the shelf 120. If a plurality of drawers 100 is mounted or provided, guides that guide withdrawal of the drawers 100 may be formed between the drawers 100.

Hereinafter, structures of the drawers, the cover, and the shelf of the refrigerator in accordance with the embodiments will be described in more detail with reference to FIGS. 3 to 5.

Figure 3:
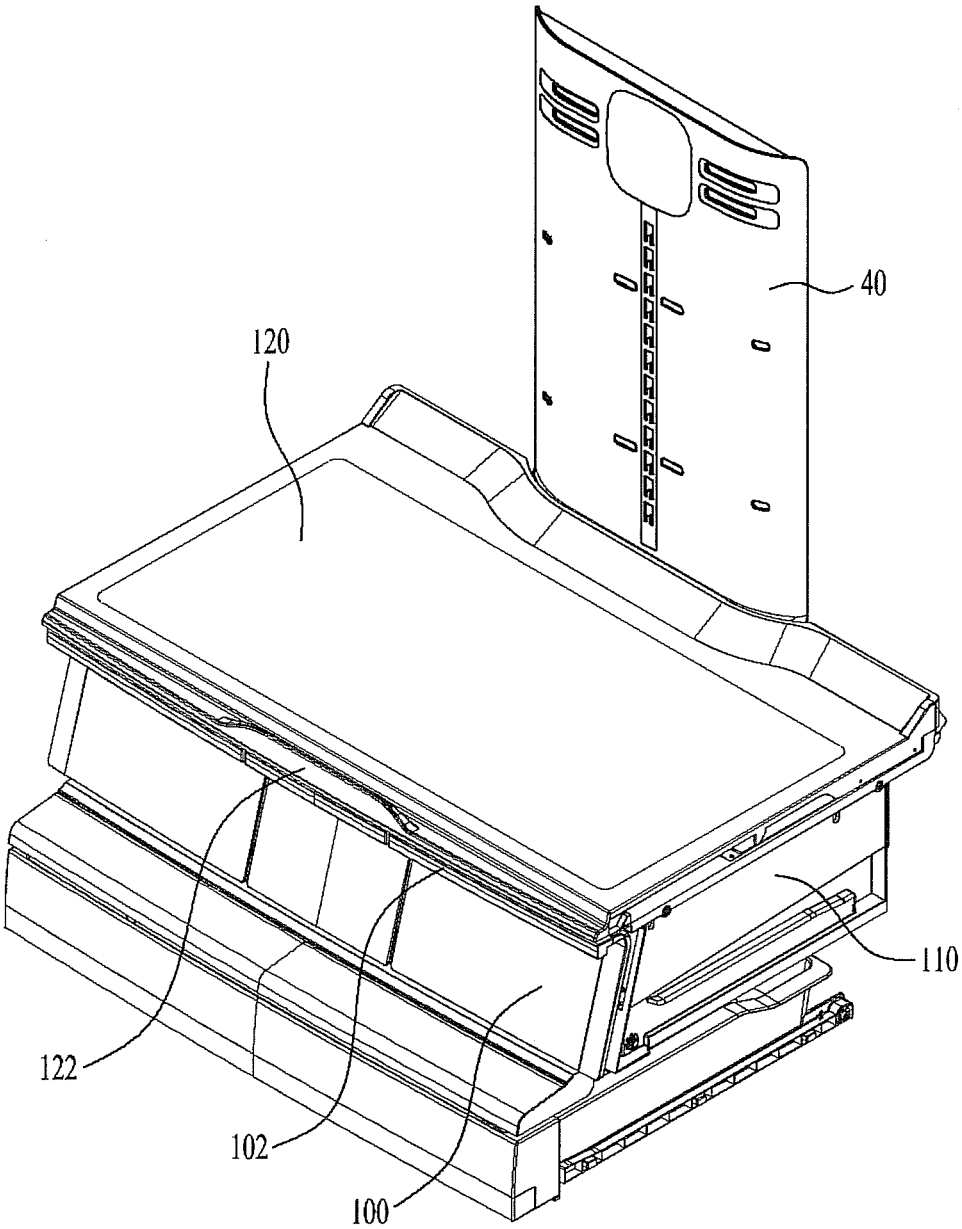
FIG. 3 is a perspective view illustrating drawers mounted in the refrigerating chamber of FIG. 2, a shelf mounted thereon, and a multi-duct.

FIG. 3 is a perspective view illustrating drawers mounted in the refrigerating chamber of FIG. 2, a shelf mounted thereon, and a multi-duct. FIG. 4 is an exploded perspective view of the shelf of FIG. 3, a cover, and components provided therebetween. FIG. 5 is an exploded perspective view illustrating support of the cover of FIG. 3 by a drawer mount.

The drawers 100 may be guided by a drawer mount 110 installed and fixed in the refrigerating chamber 10. Handles 102 may be formed on the upper portions of front surfaces of the drawers 100 so that a user may easily withdraw the drawer 100 by grasping the handle 102. The drawer mount 110 may guide the drawers 100 and support the cover 140 combined with upper surfaces of the drawer(s) 100. The drawer mount 110 may be formed in a vertical plate shape, and guides that guide withdrawal of the drawers 100 and support the drawers 100 may be formed on inner surfaces of the drawer mount 110.

A cover 140 may be combined with the drawer mount 110 so as to cover opened upper surfaces of the drawer(s) 100, and the shelf 120 may be supported by the cover 140 so as to be slidable on the cover 140. For this purpose, guide grooves 146 may be formed at left and right edges of the cover 140, and guide rails 130 that guide sliding of the shelf 120 may be fixed to the guide grooves 146. A slider 135, which will be described later, may be inserted into the guide rail 130, thus sliding while being guided. Although the shelf 120 may directly contact the cover 140, the shelf 120 may be supported through or by the guide rails 130 so as to reduce friction, thus being smoothly pulled out and increasing strength.

A pair of supports 160 may be provided at both sides of a lower surface of the shelf 120 to increase a strength of the shelf 120 and prevent warpage of the shelf 120 when the shelf 120 is pulled out. The pair of supports 160 may be supported by rollers 152, as will be described hereinbelow.

Figure 4:
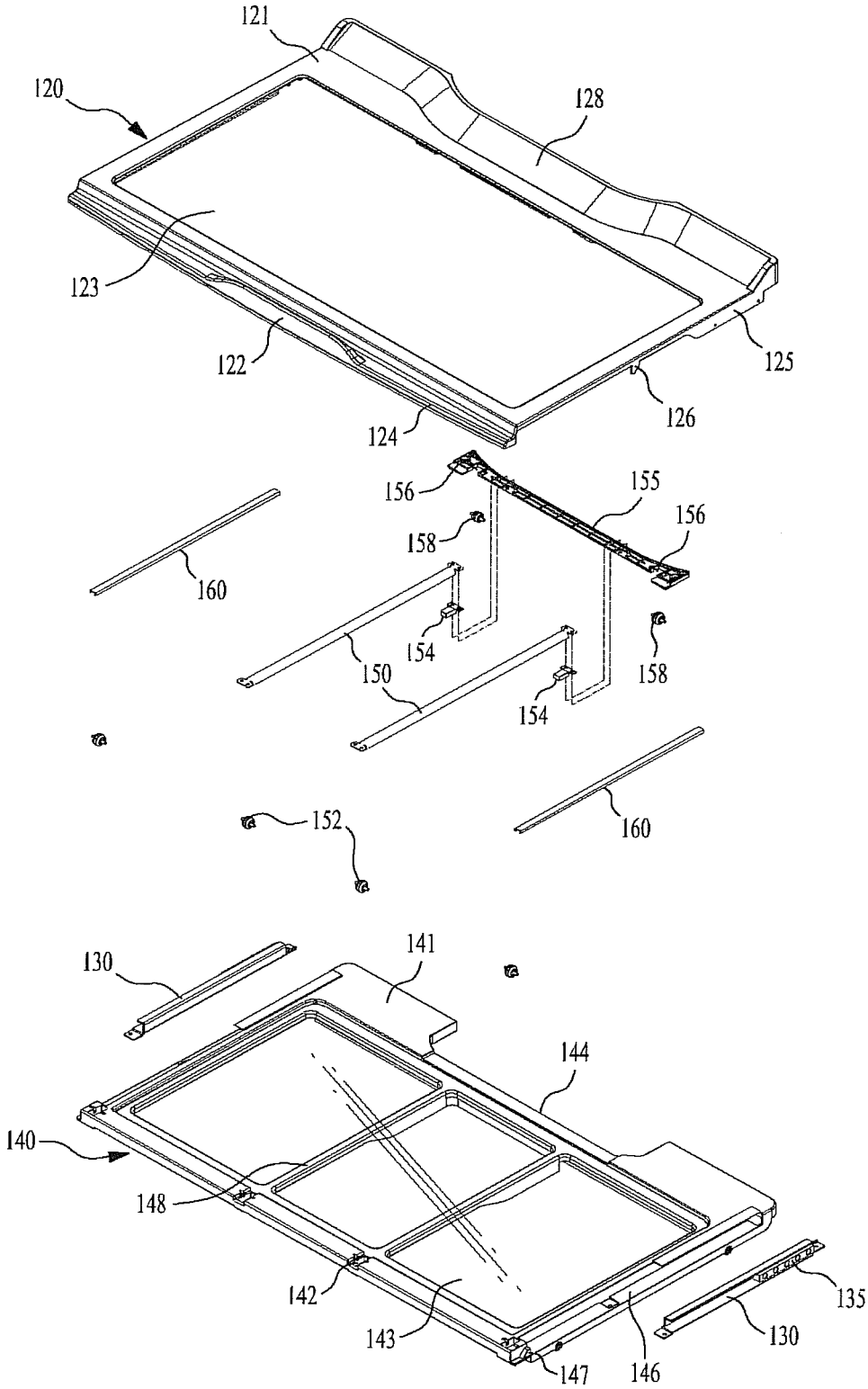
FIG. 4 is an exploded perspective view of the shelf of FIG. 3, a cover, and components provided therebetween.

As exemplarily shown in FIG. 4, a plurality of roller mounting slots 142 may be formed on an upper surface of a front portion of the cover 140. The plurality of roller mounting slots 142 may be formed at a front end of the upper surface of the cover 140. The roller mounting slots 142 may be provided so as to support the lower surface of the shelf 120. In this embodiment, three drawers 100 are disposed side by side, four roller mounting slots 142 are formed at the front portion of the cover 140, and rollers 152 are rotatably mounted in the roller mounting slots 142.

Figure 5:
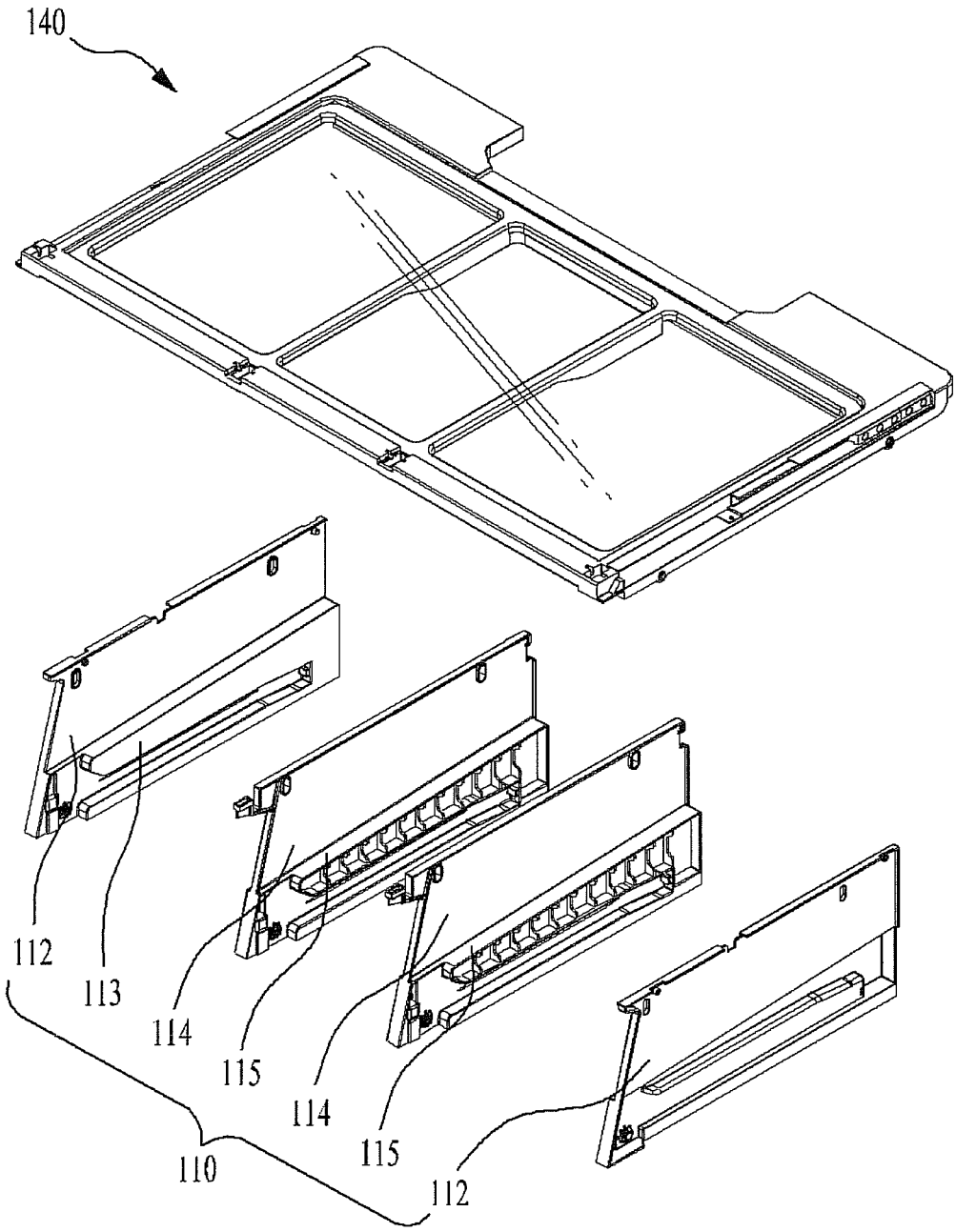
FIG. 5 is an exploded perspective view illustrating support of the cover of FIG. 3 by a drawer mount.

As exemplarily shown in FIG. 5, the drawer mount 110 of this embodiment may include a pair of side mounting parts or side mounts 112 disposed at both sides of the refrigerating chamber 10, and at least one intermediate mounting part or intermediate mount 114 disposed between the pair of side mounts 112. FIG. 5 illustrates two intermediate mounts 114. By disposing or providing two side mounts 112 and two intermediate mounts 114, three drawers 110 may be respectively mounted in three spaces divided by the two side mounts 112 and the two intermediate mounts 114.

Guide parts or guides 113 and 115 that support and guide the respective drawers 110 so as to be pulled out may be provided on or at inner surfaces of the pair of the side mounts 112 and both side surfaces of the intermediate mounts 114. Protrusions corresponding to the guides 113 and 115 may be formed on both side surfaces of the drawers 110.

Referring again to FIG. 4, the cover 140 may include a frame part or frame 141 that forms an edge of the cover 140, which may be formed of plastic, and a plate part or plate 143 fixed to an inside of the frame 141, which may be formed of glass. The above-described guide grooves 146 and roller mounting slots 142 may be formed on the plate part 141, and a receipt groove in which the plate 143 may be received may be formed at an inner region of the frame 141.

An upper surface of the frame 141 and an upper surface of the plate 143 may be coplanar with each other. As the plate 143 may be formed of transparent glass, a user may confirm stored articles accommodated within the drawers 100 placed under the plate 143 without withdrawing drawers 100. Further, the plate 143 may be formed of tempered glass so as to increase a strength of the cover 140.

The cover 140 may further include intermediate frame parts or frame(s) 148 at positions of an inner region of the frame 141 corresponding to the intermediate mounts 114. The intermediate frames 148 may support the plate 143 and be supported by the intermediate mounts 114.

A cavity 144 corresponding to an outline of protruding multi-duct 40 may be formed on or at a rear surface of the cover 140. The cover 140 may be installed close to the rear surface of the refrigerating chamber 10 by adhering the protruding multi-duct 40 close to or within the cavity 144.

The shelf 120 may include a frame part or frame 121 that forms an edge of the shelf 120, which may be formed of plastic, and a plate part or plate 123 fixed to an inside of the frame 121, which may be formed of glass. By forming the plate 123 of transparent glass, a user may confirm stored articles accommodated within the drawers 100 through the shelf 120 and the cover 140. As articles are accommodated on the shelf 120 and the shelf 120 is pulled out, the plate 123 of the shelf 120 may be formed of tempered glass so as to increase a strength of the shelf 120.

A fall prevention part or preventer 128 that prevents articles on the shelf 120 from falling backward and then falling off the shelf 120 when the shelf 120 is pulled out may be provided on an upper surface of a rear end or portion of the shelf 120. Although the fall preventer 128 may be formed separately from the shelf 120 and then combined with the shelf 120, FIG. 4 illustrates the fall preventer 128 as being formed integrally with the upper surface of the rear end or portion of the shelf 120.

The fall preventer 128 may be provided with a cavity so as not to interfere with the multi-duct 40, in the same manner as the cavity 144 of the cover 140. Further, the fall preventer 128 may protrude upward from the rear end or portion of the upper surface of the frame 121 forming the edge of the shelf 120, and the front surface of the fall preventer 128 may be inclined downward in a forward direction or toward the front of the refrigerator.

Even if an article accommodated on the shelf 120 falls over when the shelf 120 is pulled out, the fall preventer 128 may prevent the article from falling backward and then falling off the rear end or portion of the shelf 120. More particularly, the inclined surface of the fall preventer 128 may cause an article to move forward by gravity.

The refrigerator according to embodiments may further include at least one reinforcing support 150 coupled with the lower surface of the shelf 120, disposed between the pair of supports 160, and supported by the cover 140 so as to be slidable on the cover 140. As described above, if two or more drawers are horizontally mounted, the intermediate mounts 114 may be provided. The reinforcing supports 150 may be disposed above the intermediate mounts 114.

The reinforcing supports 150 may be formed of metal and coupled with the lower surface of the shelf 120 in forward and backward directions. The reinforcing supports 150 may extend in the forward and backward directions and reinforce the shelf 120 so that the shelf 120 may withstand a moment load.

The reinforcing supports 150 may be supported by the rollers 152 provided at the front portion of the upper surface of the cover 140 and support pieces 154 combined with lower surfaces of rear portions of the reinforcing supports 150. The reinforcing supports 150 may be formed of a material having low friction so as to slide on the upper surface of the cover 140.

The rollers 152 may be rotatably mounted in the roller mounting slots 142, which may be formed at a front end of a center of the frame 141 of the cover 140, as described above. That is, the rollers 152 may be rotatable, but may not move relative to the cover 140.

On the other hand, the support pieces 154 may be combined with the lower surfaces of the rear portions of the reinforcing supports 150, and move relative to the cover 140 when the reinforcing supports 150 move together with the shelf 120. Thereby, the support pieces 154 may slide on the upper surface of the cover 140, more particularly, on an upper surface of the plate 143, which may be formed of glass. The support pieces 154 may be formed of plastic having low friction with the glass surface.

Alternatively, the reinforcing supports 150 may be supported by the rollers 152 provided at the front portion of the upper surface of the cover 140 and rollers (not shown) mounted on the lower surfaces of the rear portions of the reinforcing supports 150 and supported by the upper surface of the cover 140.

Although not shown in the drawing, the rollers mounted on the lower surfaces of the rear portions of the reinforcing supports 150 may be mounted in roller mounting parts or mounts formed at the rear portions of the reinforcing supports 150, and thus, the rollers may roll on the upper surface of the cover 140.

The reinforcing supports 150 may be combined with the lower surface of the frame 121 of the shelf 120. As it is difficult to combine the reinforcing supports 150 with the plate 123 of the shelf 120, which may be formed of glass, coupling parts may be formed on the lower surface of the frame 121 and front and rear ends of the reinforcing supports 150 may be coupled with the coupling parts.

For this purpose, coupling parts 151 (with reference to FIG. 7) provided with through holes coupled with coupling parts, such as screws, may be formed at front and rear ends of the reinforcing supports 150. Further, as shearing stress due to articles accommodated on the shelf 120 may be applied to the shelf 120, in order to reinforce the shelf 120, a cross-section of the reinforcing supports 150 may be concave downward. Thus, the reinforcing supports 150 may be formed by forming the coupling parts 151 at both ends of long metal plates and then bending both sides of the long metal plates downward.

The shelf 120 may further include the sliders 135 combined with lower ends of both edges of the shelf 120 and slidably supported by the guide rails 130. Although side ends of the shelf 120 may be inserted into the guide rails 130 so as to be slidable, the sliders 135 may be formed of a material having a lower friction with the guide rails 130 than plastic forming the frame 141 of the shelf 120. Therefore, the sliders 135, which may be formed of plastic having low friction, may be separately manufactured and then combined with lower ends of both sides of the shelf 120. For this purpose, slider mounting parts or mounts 125 that extend downward may be formed at lower surfaces of rear ends of both sides of the shelf 120.

Ultra high molecular weight polyethylene (UHMW PE) may be used as such a material of the sliders 135. UHMW PE is high density polyethylene having a molecular weight of a few million and has excellent abrasion resistance, impact resistance, tensile strength and self-lubricity and has a very low coefficient of friction, thus being suitable for use as a sliding part.

As UHMW PE, GUR is generally used. GUR is a product name of ultra high molecular weight polyethylene developed by Hoechest GmbH in Germany. More particularly, GUR4120 which is a product having a molecular weight of 5 million or more may be used to form the sliders 135.

The guide rails 130 may have a ⊏-shaped cross-section and may be mounted such that opened surfaces of the guide rails 130 face the outside. When the shelf 120 is pulled out, a downward rotating moment may be applied to a front half of the shelf 120, and thus, a structure that supports the shelf 120 may be required.

Therefore, the guide rails 130 may have a ⊏-shaped cross-section so as to support the sliders 135 not only from the bottom but also from the top.

Further, by mounting the pair of guide rails 130 such that the opened surfaces of the guide rails 130 face the outside, inner surfaces of the guide rails 130 may support the sliders 135 from the inside, and thus, shaking of the shelf 120, with which the sliders 135 are combined, from side to side may be prevented.

The slider mounts 125 may extend downward from lower ends of rear portions of both sides of the shelf 120, and the sliders 135 may be coupled with inner surfaces of the slider mounts 125 by coupling members, such as screws.

The guide rails 130 may be coupled with the guide grooves 146 by, for example, screws. A length of the guide rails 130 may be smaller than a length of the guide grooves 146, and thus, the guide rails 130 may be mounted at rear portions of the guide grooves 146.

A length difference between the guide grooves 146 and the guide rails 130 may be greater than a length of the sliders 135, and portions of the guide grooves 146 corresponding to the length difference may be opened upward. Therefore, the sliders 135 may be inserted into the guide rails 130 even under a condition that the guide rails 130 are coupled with the cover 140 and the sliders coupled with the shelf 120.

Figure 6:
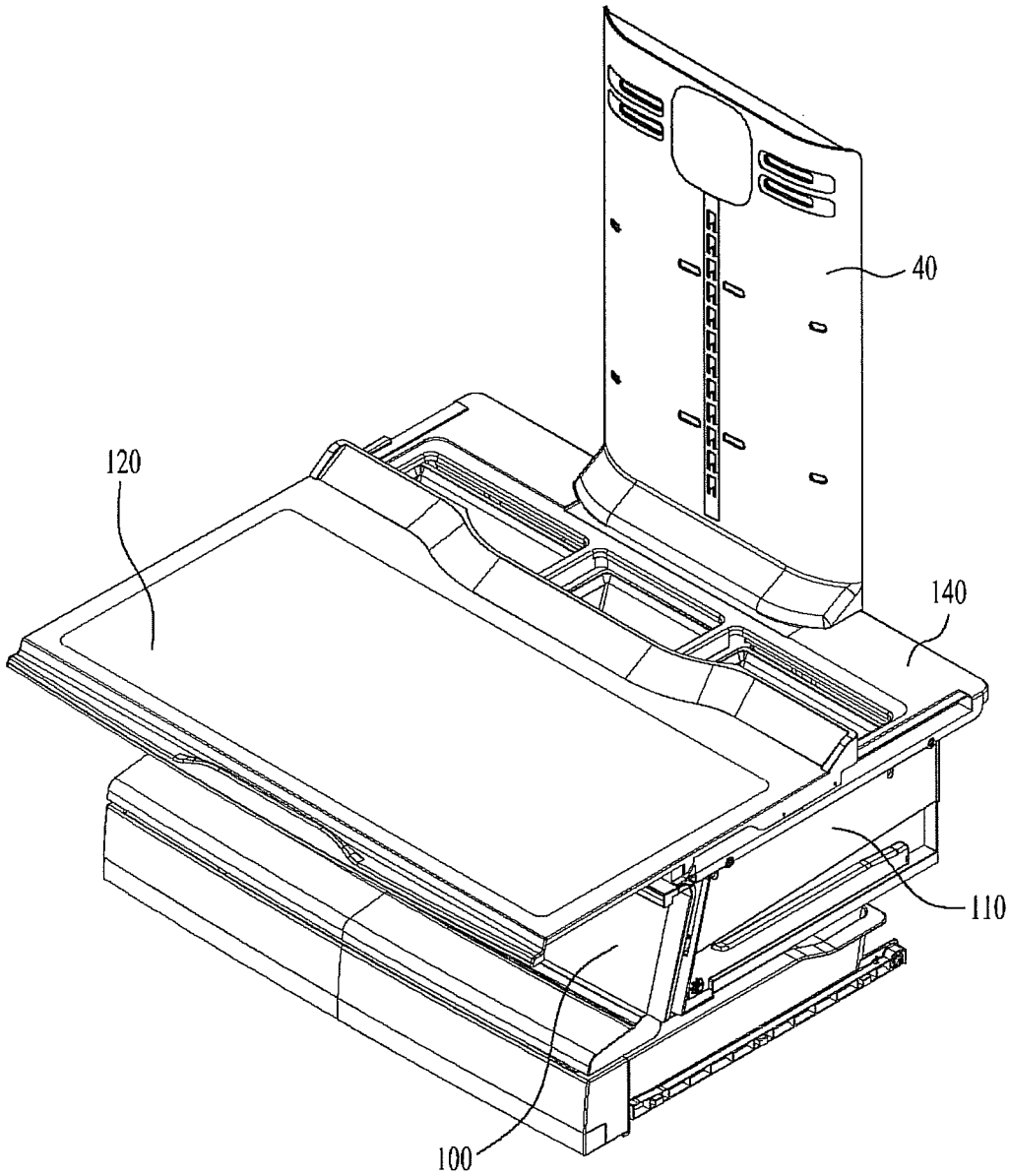
FIG. 6 is a perspective view illustrating a state in which the shelf on the drawers of FIG. 3 is pulled out.

FIG. 6 illustrates a state in which the shelf on the drawers of FIG. 3 is pulled out. When a user grasps and pulls a handle 122 of the shelf 120 forward, the shelf 120 is pulled out while sliding on the cover 140. The cover 140 supported by the drawer mount 110 may stably support the shelf 120 even if the shelf 120 is pulled out, and the cover 140 may maintain a closed state of the drawers 100 regardless of whether or not the shelf 120 is pulled out.

Figure 7:
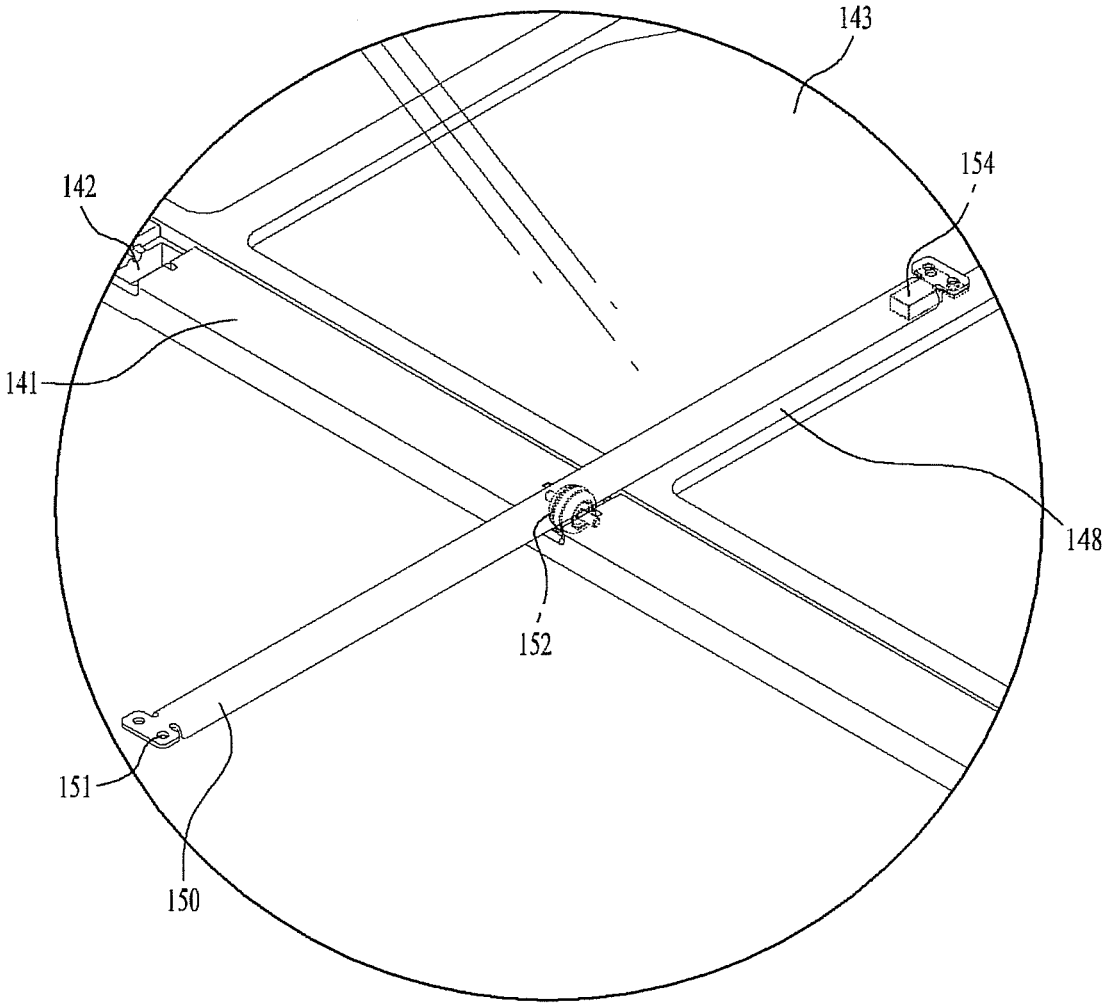
FIG. 7 is a partial perspective view illustrating support of a reinforcing support by a roller and a support piece in accordance with embodiments.

FIG. 7 is a partial perspective view illustrating support of a reinforcing support by a roller and a support piece in accordance with embodiments. The reinforcing supports 150 coupled with the shelf 120 may slide forward under the condition that the reinforcing supports 150 are supported by the rollers 152 mounted in the roller mounting slots 142 of the frame 141 and the support pieces 154 combined with the lower surfaces of the rear portions of the reinforcing supports 150 and sliding on the upper surface of the plate 143 of the cover 140. The shelf 120 may be configured so as to be pulled out by about half a length of the shelf 120 in forward and backward directions.

If the shelf 120 is pulled out by a longer length, a user may more conveniently accommodate articles on the shelf 120 and retrieve articles from the shelf 120. However, if the shelf 120 is excessively pulled out, it may be difficult for the shelf 120 to withstand a moment due to weight of the articles, and thus, the shelf 120 may be configured such that withdrawal of the shelf 120 is stopped halfway. For this purpose, the cover 140 may further include stoppers 147 that determine a maximum withdrawal position of the shelf 120, and the shelf 120 may further include protrusions 126 selectively locked with the stoppers 147.

The stoppers 147 may be formed at front ends of the guide grooves 146 of the cover 140. More particularly, the stoppers 147 may protrude upward from the front ends of the guide grooves 146 of the cover 140, as exemplarily shown in FIG. 4.

Correspondingly, protrusions 126 may be formed at lower ends of both side edges of the frame 121 of the shelf 120. More particularly, the protrusions 126 may protrude downward from both side edges of the frame 121.

Figure 8:
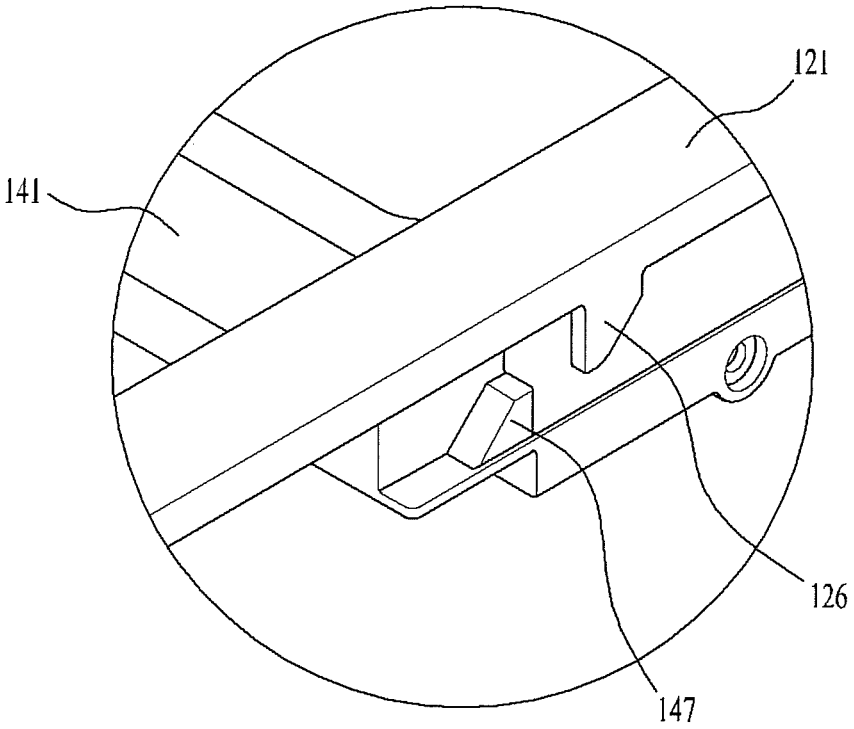
FIG. 8 is a partial perspective view illustrating locking of protrusions formed at both sides of the shelf to stoppers formed at both sides of a front portion of the cover in accordance with embodiments.

As exemplarily shown in FIG. 8, front surfaces of the stoppers 147 may be inclined, and rear surfaces of the protrusions 126 may be inclined so as to correspond to the front inclined surfaces of the stoppers 147.

When the shelf 120 is mounted on the cover 140, the shelf 120 needs to be pushed in so as to insert the sliders 135 into the guide rails 130. At this time, the inclined surfaces of the protrusions 126 may pass over the inclined surfaces of the stoppers 147, and thus, the shelf 120 may be smoothly mounted on the cover 140.

On the other hand, when the shelf 120 is pulled out after being mounted on the cover 140, front vertical surfaces of the protrusions 126 may be locked with rear vertical surfaces of the stoppers 147, and thus, the maximum withdrawal position of the shelf 120 determined. The maximum withdrawal position of the shelf 120 may be properly adjusted by adjusting positions of the protrusions 126 and the stoppers 147.

As exemplarily shown in FIG. 4, the refrigerator in accordance with embodiments may further include a horizontal support 155 coupled with the rear end of the lower surface of the shelf 120 in a horizontal direction and combined with the at least one reinforcing support 150. The horizontal support 155 may be provided, if the width of the shelf 120 is large, and serve to reinforce the rear portion of the frame 121 of the shelf 120 and to facilitate the combination of the reinforcing supports 150 with the shelf 120.

The horizontal support 155 may include coupling holes formed at a central portion thereof so as to be coupled with the at least one reinforcing support 150, roller mounting parts or mounts 156 formed at both sides thereof, and rollers 158 mounted in the roller mounts 156 and supported on the cover 140.

If two reinforcing supports 150 are provided, as exemplarily shown in FIG. 4, two coupling holes, one for each reinforcing support 150, by which the reinforcing supports 150 and the support pieces 154 may be coupled, may be formed at the central portion of the horizontal support 155 at a designated interval.

By connecting the coupling members to the lower end of the frame 121 of the shelf 120 through the coupling holes, the horizontal support 155, the support pieces 154, the reinforcing supports 150, and the shelf 120 may be coupled all at once in order in an upward direction.

The roller mounts 156 may be in the form of slots in which the rollers 158 may be mounted from a bottom so as to be rotatable and may be formed at both ends of the horizontal support 155. Thereby, the horizontal support 155 may be supported by the upper surface of the cover 140 so as to be slidable on the upper surface 140 of the cover 140 by the rollers 158.

Figure 9:
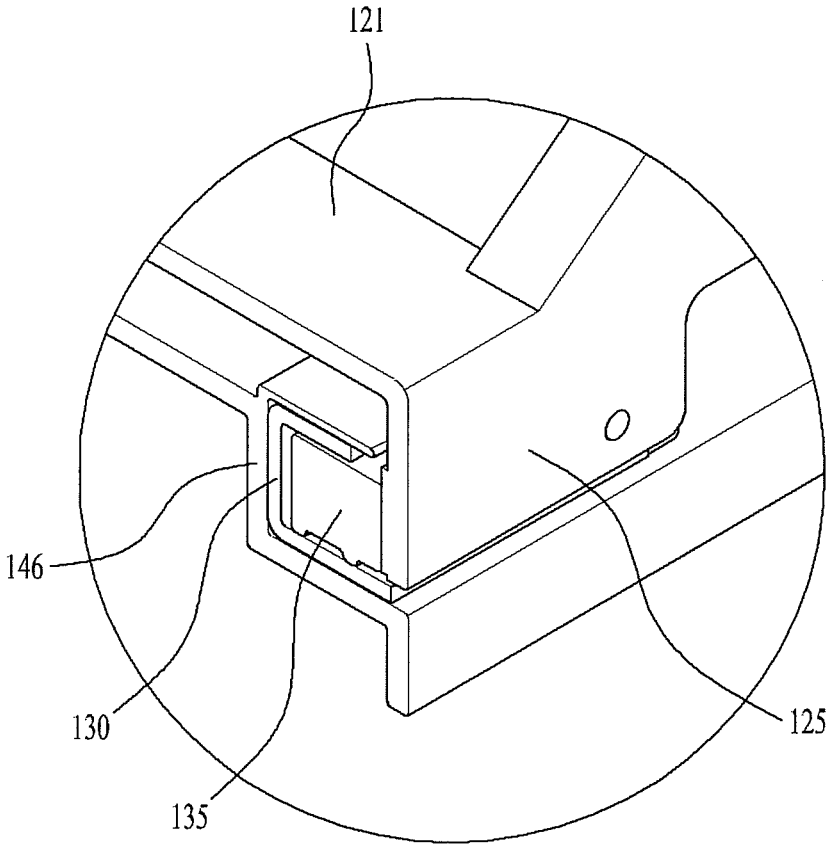
FIG. 9 is a partial cross-sectional perspective view illustrating mounting of a guide rail in a rail mounting groove of the cover and insertion of a slider, combined with one side of the cover, into the guide rail in accordance with embodiments.
Figure 10:
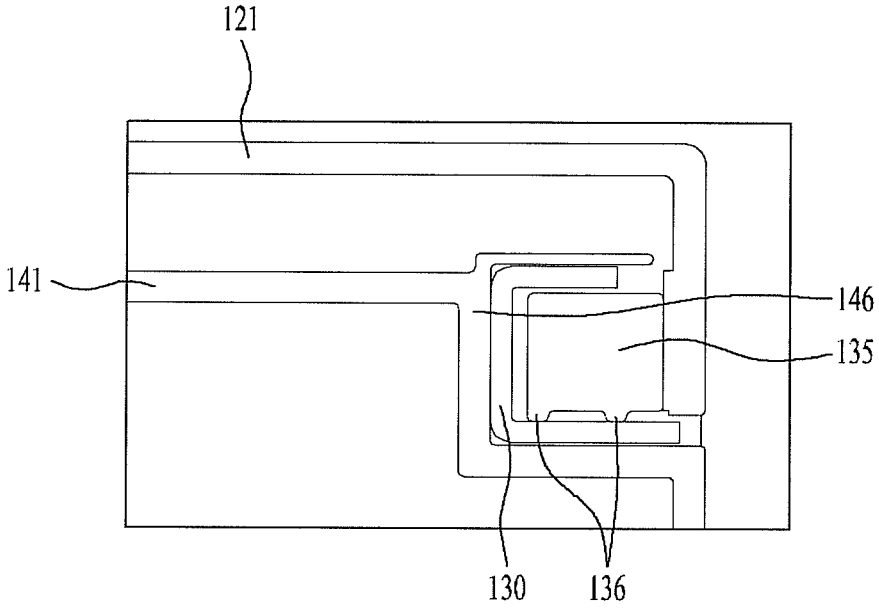
FIG. 10 is a cross-sectional view of FIG. 9, as seen from the front.

Finally, FIG. 9 is a partial cross-sectional perspective view illustrating mounting of the guide rail in the rail mounting groove of the cover and insertion of the slider, combined with one side of the cover, into the guide rail, and FIG. 10 is a cross-sectional view of FIG. 9, as seen from the front.

The guide rail 130 may be mounted in the guide groove 146 formed at a right side of the cover 140 such that the guide rail 130 is opened rightward, and the slider 135 combined with the inner surface of the slider mount 125 of the frame 121 of the shelf 120 may be inserted into the guide rail 130. The slider 135 may have a rectangular parallelepipedal shape which may extend longitudinally, and the lower surface of the slider 135 may be level.

However, as exemplarily shown in FIG. 10, by forming protrusions 136 on a lower surface of the slider 135, a contact area of the lower surface of the slider 135 with a bottom surface of the guide rail 130 may be reduced, and thus, friction therebetween may be reduced. Therefore, contact between the lower surface of the slider 135 and the bottom surface of the guide rail 130 may be close to line contact rather than area contact by forming two or more protrusions 136 on the lower surface of the slider 135 in a lengthwise direction.

Further, a side surface of the guide rail 130 and a side surface of the slider 135 may be separated from each other by a designated distance. Such a distance may be properly designed such that dimensional tolerances are considered and shaking of the shelf 120 from side to side may be prevented when the shelf 120 is moved.

Contact between the side surface of the guide rail 130 and the side surface of the slider 135 from the beginning may cause friction resistance on a contact surface, and thus, may be prevented. Therefore, a designated gap may be formed between the side surface of the guide rail 130 and the side surface of the slider 135 so as to minimize friction therebetween.

As described above, in a refrigerator in accordance with embodiments, a shelf on drawers used as closed storage spaces may be provided so as to be pulled out and the storage spaces within the drawers may maintain a closed state regardless of withdrawal of the shelf. Further, the shelf may be smoothly pulled out even if articles are placed on the shelf, and warpage of the shelf due to heavy articles may be prevented.

As apparent from the above description, in a refrigerator in accordance with embodiments, a shelf located on drawers may be pulled out and insides of the drawers may be closed at all times. Further, the shelf on the drawers may be smoothly pulled out, and thus, stored articles on the shelf may be easily retrieved. Furthermore, as a handle is provided on the front surface of the shelf and both sides of the shelf are supported by rails or rollers, a user may easily and smoothly insert and withdraw the shelf.

Further, a plurality of supporters or supports may be combined with the lower surface of the shelf, and thus, even when a heavy article is placed on the shelf, deformation of the shelf due to the load of the article may be minimized.

Moreover, a fall prevention part or preventer may be provided at the rear portion of the drawer, and thus, falling of articles accommodated on the shelf off the shelf may be prevented.

Embodiments disclosed herein are directed to a refrigerator that substantially obviates one or more problems due to limitations and disadvantages of the related art.

Embodiments disclosed herein provide a refrigerator in which a shelf on drawers may be smoothly pulled out and the drawers may be closed at all times.

Embodiments disclosed herein provide a refrigerator that may include a main body provided with storage chamber, a drawer mounting unit or mount installed in the storage chamber that guides a drawer provided therein so as to be pulled out, the drawer mounted in an inner space of the drawer mounting unit so as to be pulled out, a cover configured so as to cover an opening of an upper surface of the drawer, and including guide grooves formed at left and right edges of the cover and guide rails mounted in the guide grooves and formed of metal, a shelf supported by the cover so as to be slidable on the cover by the guide rails, and a pair of supporters or supports provided at both sides of a lower surface of the shelf. The drawer mounting unit may include a pair of side mounting parts or mounts disposed at both sides of the drawer mounting unit and at least one intermediate mounting part or mount disposed between the pair of side mounting parts, and a plurality of drawers may be mounted in a plurality of spaces divided by the pair of side mounting parts and the at least one intermediate mounting part.

The refrigerator may further include at least one reinforcing supporter or support coupled with the lower surface of the shelf, disposed on the at least one intermediate mounting part between the pair of supporters, and supported by the cover so as to be slidable on the cover. The pair of supporters may be supported by rollers mounted on an upper surface of a front portion of the cover.

Each of the cover and the shelf may include a frame part or frame that forms an edge of each of the cover and the shelf, which may be formed of plastic, and a plate part or plate fixed to an inside of the frame part, which may be formed of glass.

The at least one reinforcing supporter may be coupled with the lower surface of the shelf in forward and backward directions, and the at least one reinforcing supporter may be supported by rollers provided at a front portion of an upper surface of the cover and rollers mounted on a lower surface of a rear portion of the at least one reinforcing supporter and supported by the upper surface of the cover.

The at least one reinforcing supporter may be coupled with the lower surface of the shelf in the forward and backward directions, and the at least one reinforcing supporter may be supported by rollers provided at the front portion of the upper surface of the cover and support pieces combined with the lower surface of the rear portion of the at least one reinforcing supporter and formed of a material having low friction so as to be slidable on the upper surface of the cover. The at least one reinforcing supporter may be combined with the lower portion of the frame part of the shelf. A cross-section of the at least one reinforcing supporter may be concave downward.

The shelf may include sliders combined with lower ends of both edges of the shelf and supported by the guide rails so as to be slidable. The sliders may be formed of plastic having low friction. The guide rails may have a ⊏-shaped cross-section and be mounted such that the opened surfaces thereof face the outside.

The cover may further include stoppers that determine a maximum withdrawal position of the shelf, and the shelf may further include protrusions selectively locked with the stoppers. The stoppers may be formed at front ends of the guide grooves of the cover, and the protrusions may be formed at lower ends of both edges of the frame part of the shelf.

Guide parts that slidably support the drawers may be formed on opposite side surfaces of the pair of side mounting parts and the at least one intermediate mounting part.

The shelf may include a handle formed at an upper portion of a front end thereof. The shelf may include a fall prevention part or preventer formed on an upper surface of a rear end thereof that prevents articles on the shelf from falling backward and then falling off the shelf when the shelf is pulled out. The fall prevention part may protrude upward from the rear end of the upper surface of the frame part that forms the edge of the shelf, and the front surface of the fall prevention part may be inclined downward toward the front.

The refrigerator may further include a horizontal supporter or support coupled with the rear end of the lower surface of the shelf in a horizontal direction and combined with the at least one reinforcing supporter. The horizontal supporter may include coupling holes formed at a central portion thereof so as to be coupled with the at least one reinforcing supporter, roller mounting parts formed at both sides thereof, and rollers mounted in the roller mounting parts and supported on the cover. The front end of the shelf may extend so as to shield a front surface of the cover.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a main body having at least one storage chamber;

a drawer mount installed in the at least one storage chamber, that guides at least one drawer provided therein so as to be inserted into and pulled out of the at least one storage chamber;

a cover configured to cover an opening at an upper surface of the at least one drawer, and the cover including guide grooves formed at left and right edge portions of the cover and guide rails mounted in the guide grooves;

a shelf supported by the cover to be slidable on the cover by the guide rails; and a pair of supports provided at both sides of a lower surface of the shelf, wherein the pair of supports is supported by rollers mounted on an upper surface of a front portion of the cover.

2. The refrigerator according to claim 1, wherein the guide rails are formed of metal.

3. The refrigerator according to claim 1, wherein the drawer mount includes a pair of side mounts and at least one intermediate mount disposed between the pair of side mounts, and wherein the at least one drawer includes a plurality of drawers mounted in a plurality of spaces divided by the pair of side mounts and the at least one intermediate mount.

4. The refrigerator according to claim 3, further comprising at least one reinforcing support coupled with a lower surface of the shelf, disposed on the at least one intermediate mount between the pair of supports, and supported by the cover to be slidable on the cover.

5. The refrigerator according to claim 4, wherein at least one reinforcing support is coupled with a lower surface of the shelf and extends in forward and backward directions, and wherein the at least one reinforcing support is supported by rollers provided at a front portion of an upper surface of the cover and rollers mounted on a lower surface of a rear portion of the at least one reinforcing support and supported by an upper surface of the cover.

6. The refrigerator according to claim 5, wherein the at least one reinforcing support is combined with a lower portion of the frame of the shelf.

7. The refrigerator according to claim 4, wherein at least one reinforcing support is coupled with a lower surface of the shelf and extends in forward and backward directions, and wherein the at least one reinforcing support is supported by rollers provided at a front portion of an upper surface of the cover and support pieces combined with a lower surface of a rear portion of the at least one reinforcing support and formed of a material having low friction so as to be slidable on an upper surface of the cover.

8. The refrigerator according to claim 7, wherein the at least one reinforcing support is combined with a lower portion of the frame of the shelf.

9. The refrigerator according to claim 8, wherein a cross-section of the at least one reinforcing support is concave downward.

10. The refrigerator according to claim 3, wherein guides that slidably support the plurality of drawers are formed on opposite side surfaces of the pair of side mounts and the at least one intermediate mount.

11. The refrigerator according to claim 1, wherein each of the cover and the shelf includes:

a frame that forms an edge thereof; and a plate fixed to or at an inside of the frame.

12. The refrigerator according to claim 11, wherein the frame is formed of plastic and the plate is formed of glass.

13. The refrigerator according to claim 1, wherein the shelf includes a handle formed at an upper portion of a front end thereof.

14. The refrigerator according to claim 1, wherein the shelf includes a fall preventer formed on an upper surface of a rear portion thereof, that prevents articles on the shelf from falling backward and then falling off the shelf when the shelf is pulled out.

15. The refrigerator according to claim 14, wherein the fall preventer protrudes upward from a rear end of the upper surface of a frame that forms an edge of the shelf, and a front surface of the fall preventer is inclined downward toward the front.

16. The refrigerator according to claim 1, further comprising a horizontal support coupled with a rear end of a lower surface of the shelf in a horizontal direction and combined with at least one reinforcing support.

17. The refrigerator according to claim 16, wherein the horizontal support includes:

coupling holes formed at a central portion thereof so as to be coupled with the at least one reinforcing support;

roller mounts formed at both sides thereof; and rollers mounted in the roller mounts and supported on the cover.

18. The refrigerator according to claim 1, wherein a front end of the shelf extends so as to shield a front surface of the cover.

19. A refrigerator, comprising:

a main body having at least one storage chamber;

a drawer mount installed in the at least one storage chamber, that guides at least one drawer provided therein so as to be inserted into and pulled out of the at least one storage chamber;

a cover configured to cover an opening at an upper surface of the at least one drawer, and the cover including guide grooves formed at left and right edge portions of the cover and guide rails mounted in the guide grooves;

a shelf supported by the cover to be slidable on the cover by the guide rails; and a pair of supports provided at both sides of a lower surface of the shelf, wherein the shelf includes sliders provided at lower ends of both edge portions of the shelf and supported by the guide rails so as to be slidable.

20. The refrigerator according to claim 19, wherein the sliders are formed of plastic having low friction.

21. The refrigerator according to claim 20, wherein the guide rails have a ⊏-shaped cross-section and are mounted such that opened surfaces thereof face toward the outside.

22. The refrigerator according to claim 19, wherein the cover further includes stoppers that determine a maximum withdrawal position of the shelf, and wherein the shelf further includes protrusions that selectively lock with the stoppers.

23. The refrigerator according to claim 22, wherein the stoppers are formed at front end portions of the guide grooves of the cover, and wherein the protrusions are formed at lower end portions of both edges of a frame of the shelf.

24. A refrigerator, comprising:

a main body having at least one storage chamber;

a drawer mount installed in the at least one storage chamber, that guides at least one drawer provided therein so as to be inserted into and pulled out of the at least one storage chamber;

a cover configured to cover an opening at an upper surface of the at least one drawer;

a shelf supported by the cover to be slidable with respect to the cover; and a pair of supports provided at both sides of a lower surface of the shelf, wherein the pair of supports is supported by rollers mounted on an upper surface of a front portion of the cover.

25. The refrigerator according to claim 24, wherein the drawer mount includes a pair of side mounts and at least one intermediate mount disposed between the pair of side mounts, and wherein the at least one drawer comprises a plurality of drawers mounted in a plurality of spaces divided by the pair of side mounts and the at least one intermediate mount.

26. The refrigerator according to claim 25, further comprising at least one reinforcing support coupled with a lower surface of the shelf, disposed at a position corresponding to a position of the at least one intermediate mount between the pair of supports, and supported by the cover so as to be slidable on the cover.

27. The refrigerator according to claim 24, wherein each of the cover and the shelf includes:

a frame that forms an edge thereof; and a plate fixed to or at an inside of the frame.

28. The refrigerator according to claim 27, wherein the frame is formed of plastic and the plate is formed of glass.

29. A refrigerator, comprising:

a main body having at least one storage chamber;

a drawer mount installed in the at least one storage chamber, that guides at least one drawer provided therein so as to be inserted into and pulled out of the at least one storage chamber;

a cover configured to cover an opening at an upper surface of the at least one drawer; and a shelf supported by the cover to be slidable with respect to the cover, wherein the shelf includes sliders provided at lower ends of both edge portions of the shelf and supported by guide rails so as to be slidable.

30. The refrigerator according to claim 29, wherein the guide rails have a -shaped cross-section and are mounted such that opened surfaces thereof face toward the outside.

31. The refrigerator according to claim 29, wherein the cover includes stoppers that determine a maximum withdrawal position of the shelf, and wherein the shelf further includes protrusions selectively locked with the stoppers.

* * * * *